US008118657B2

(12) United States Patent
Marks et al.

(10) Patent No.: US 8,118,657 B2
(45) Date of Patent: Feb. 21, 2012

(54) METHOD FOR A PLURALITY OF PLAYERS TO SIMULTANEOUSLY WAGER ON THE SAME GAMING DEVICE

(75) Inventors: Daniel Mordecai Marks, Cold Spring, NY (US); Anthony Mark Singer, Ramsey, NJ (US)

(73) Assignee: PTT LLC, Mahwah, NJ (US)

( * ) Notice: Subject to any disclaimer, the term of this patent is extended or adjusted under 35 U.S.C. 154(b) by 614 days.

(21) Appl. No.: 12/221,889

(22) Filed: Aug. 7, 2008

(65) Prior Publication Data

US 2008/0305861 A1 Dec. 11, 2008

Related U.S. Application Data

(63) Continuation-in-part of application No. 11/455,292, filed on Jun. 15, 2006, now Pat. No. 7,837,553, which is a continuation-in-part of application No. 10/438,325, filed on May 15, 2003, now Pat. No. 7,278,914.

(60) Provisional application No. 60/380,485, filed on May 15, 2002, provisional application No. 60/412,012, filed on Sep. 20, 2002, provisional application No. 60/445,769, filed on Feb. 10, 2003.

(51) Int. Cl.
*A63F 9/24* (2006.01)

(52) U.S. Cl. ..... 463/16; 463/17; 463/20; 463/25; 463/29

(58) Field of Classification Search ..... 463/16, 463/20, 25
See application file for complete search history.

(56) References Cited

U.S. PATENT DOCUMENTS 4,805,907 A * 2/1989 Hagiwara ..... 463/26
6,312,332 B1 * 11/2001 Walker et al. ..... 463/23

* cited by examiner

*Primary Examiner* — Omkar Deodhar
(74) *Attorney, Agent, or Firm* — Jon Fallon, Esq.

(57) ABSTRACT

The Present Invention teaches methods to allow multiple players to simultaneously wager on the same gaming device. In one embodiment, two or more players place simultaneous wagers upon the results of the same gaming device and each player collects the maximum award, if issued. In another embodiment, two or more players simultaneously wager on the results of the same gaming device and each player collects the biggest award issued. In another embodiment, two or more players simultaneously wager on the results of the same gaming device and each player collects any award or sub-set of awards issued.

19 Claims, 3 Drawing Sheets

METHOD FOR A PLURALITY OF PLAYERS TO SIMULTANEOUSLY WAGER ON THE SAME GAMING DEVICE

PRIORITY CLAIM

This application is a continuation-in-part of U.S. application Ser. Nos. 11/455,292, filed on Jun. 15, 2006, which is a continuation-in-part of U.S. application Ser. No. 10/438,325, filed May 15, 2003, now U.S. Pat. No. 7,278,914, which claims priority from U.S. Provisional Application Nos. 60/380,485, filed May 15, 2002, 60/412,012, filed Sep. 20, 2002, and 60/445,769, filed Feb. 10, 2003. All of these applications are incorporated herein by reference.

COPYRIGHT NOTICE

A portion of the disclosure of this patent document contains or may contain material subject to copyright protection. The copyright owner has no objection to the photocopy reproduction of the patent document or the patent disclosure in exactly the form it appears in the Patent and Trademark Office patent file or records, but otherwise reserves all copyright rights.

FIELD OF INVENTION

In general, the Present Invention relates to methods of wagering upon gaming devices and, in particular, methods for a plurality of players to simultaneously wager upon the same gaming device.

BACKGROUND OF THE INVENTION

To play a conventional slot machine, the player deposits money into the machine, sets the wager, and spins the reels. When the reels stop spinning, the player collects credits for winning symbol combinations displayed on the reels, if any, according to a predetermined pay schedule.

While the appearance of conventional slot machines may change from one theme, such as space aliens, to another theme, such as farm animals, the underlying methods of play—setting the wager, spinning the reels, collecting awards—remain the same from machine to machine.

For example, conventional slot machine games only allow a single player to place a wager and collect an award, if any, for each spin of a game. For example, a slot machine game allows a player to place a wager of 50 credits with by betting 5 credits on each of 10 pay lines. The slot machine then spins and awards the player 100 credits for a 75-credit winning symbol combination on one pay line and a 25-credit winning symbol combination on another pay line. In this manner, conventional slot machines are limited to one player, one wager, and one award for one spin on one machine.

The many similarities of conventional slot machines limit the value of the slot machine games for players, casinos, and manufacturers. Players tire of the same methods of play; casinos cannot distinguish their games from other casinos; and manufacturers cannot distinguish their products from other manufacturers. Therefore, new methods of playing slot machine games, including novel methods of allowing multiple players to place wagers and collect awards on the same game of the same machine, are required to enhance the value of these games to players, casinos, and manufacturers.

SUMMARY OF THE INVENTION

The Present Invention includes a gaming machine apparatus and a variety of methods of play that allow a plurality of players to simultaneously wager upon and collect awards from the same gaming device. Preferred embodiments of the Present Invention operate in one or more of the following manners:

Maximum Award—The Maximum Award embodiment of the Present Invention allows two or more players to place simultaneous wagers upon the results of the same gaming device and each collect the maximum award, if issued.

Player A purchases a number of spins ("X" spins) on a slot machine device ("Slot 1"). Any player or combination of players then wagers upon and spins the reels to complete the X spins of Slot 1. The players operating the game collect awards in accordance with the game's pay schedule. If Slot 1 issues the maximum award during X spins, Player A also collects a maximum award.

Biggest Award—The Biggest Award embodiment of the Present Invention allows two or more players to simultaneously wager on the results of the same gaming device and each collect the biggest award issued.

Player B purchases a number of spins ("Y" spins) on a slot machine device ("Slot 2"). Any player or combination of players then wagers upon and spins the reels to complete the Y spins of Slot 2. The players operating the game collect awards in accordance with the game's pay schedule. At the conclusion of Y spins, the biggest award issued during Y spins is also issued to Player B.

Any Award or Award Sub-Set—The Any Award embodiment of the Present Invention allows two or more players to simultaneously wager on the results of the same gaming device and each collect any award or sub-set of awards issued (i.e. all winning "7" symbol awards).

Player C purchases a number of spins ("Z" spins) on a slot machine device ("Slot 3"). Any player or combination of players then wagers upon and spins the reels to complete the Z spins of Slot 3. The players operating the game collect awards in accordance with the game's pay schedule. If Slot 3 issues any member of the sub-set of awards during Z spins (i.e. "7-7-7"), Player A also collects said award.

For each of the preferred embodiments, the purchase cost of spins is calculated by multiplying the odds of achieving the award or awards (O) times the amount of the award (A) times the number of spins purchased (N) times a hold-factor designed to provide the casino with a profitable revenue stream (H); or, O*A*N*H.

For example: a game in which the odds of achieving the maximum award on any pay line is 0.000001, the maximum award is 10,000 credits, the number of spins is 100, and the hold-factor is 1.1 results in a purchase cost $1.10 or 0.000001*10,000*100*1.1. After making the purchase, Player A would then receive 10,000 credits if the maximum award was issued during the 100 purchased spins.

All of the embodiments described above describe methods for a plurality of players to simultaneously wager upon a single gaming device. The Present Invention, however, also allows for tournament embodiments that involve simultaneous wagering upon multiple machines, as follows:

Simple Tournament—The Simple Tournament embodiment of the Present Invention allows two or more players to place simultaneous wagers upon the results of one device amongst a plurality of gaming devices and then provides players wagering upon the winning gaming device to collect an award.

Player A purchases a predetermined number of spins ("X" spins) on one slot machine device ("Slot 1") of ten slot machine devices ("Slot 1" through "Slot 10"). Player B purchases the same predetermined number of spins ("X" spins) on another slot machine device ("Slot 2"). At a predetermined start time, all of the ten slot machines begin to spin and complete X spins. If Slot 1 wins the tournament, Player A and all other bettors on Slot 1 collect an award. If Slot 2 wins the tournament, Player B and all other bettors on Slot 2 collect an award.

Head-to-Head Tournament—The Head-to-Head Tournament embodiment, a variant of the Simple Tournament, allows players to select between two gaming devices (i.e. Elvis Presley slot game vs. Frank Sinatra slot game). The device that collects the most credits over the same number of pre-determined spins or the first machine to reach a pre-determined goal wins the competition. The winning device may then re-match against the losing device or compete against a new challenger device.

Knock-Out Tournament—The Knock-Out Tournament embodiment, another variant of the Simple Tournament, allows players to select a device from a group of devices that compete in head-to-head matches across multiple rounds. The winners of each round are matched up to compete in the subsequent round; the losers of each round are eliminated. By process of elimination, the final round matches the final two devices and determines the winning device.

The stand-alone and tournament embodiments above describe only a few of the many features and advantages of the Present Invention. This application, however, is intended to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to.

BRIEF DESCRIPTION OF THE DRAWINGS

The accompanying figures illustrate various stages of a preferred embodiment of the Present Invention.

DESCRIPTION OF A PREFERRED EMBODIMENT

Reference now will be made in detail to the presently preferred embodiments of the invention. Such embodiments are provided by way of explanation of the invention, which is not intended to be limited thereto. In fact, those of ordinary skill in the art may appreciate upon reading the present specification and viewing the present drawings that various modifications and variations can be made.

For example, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the Present Invention.

Simultaneous Wagers by a Plurality of Players on the Same Gaming Device

Figure 1:
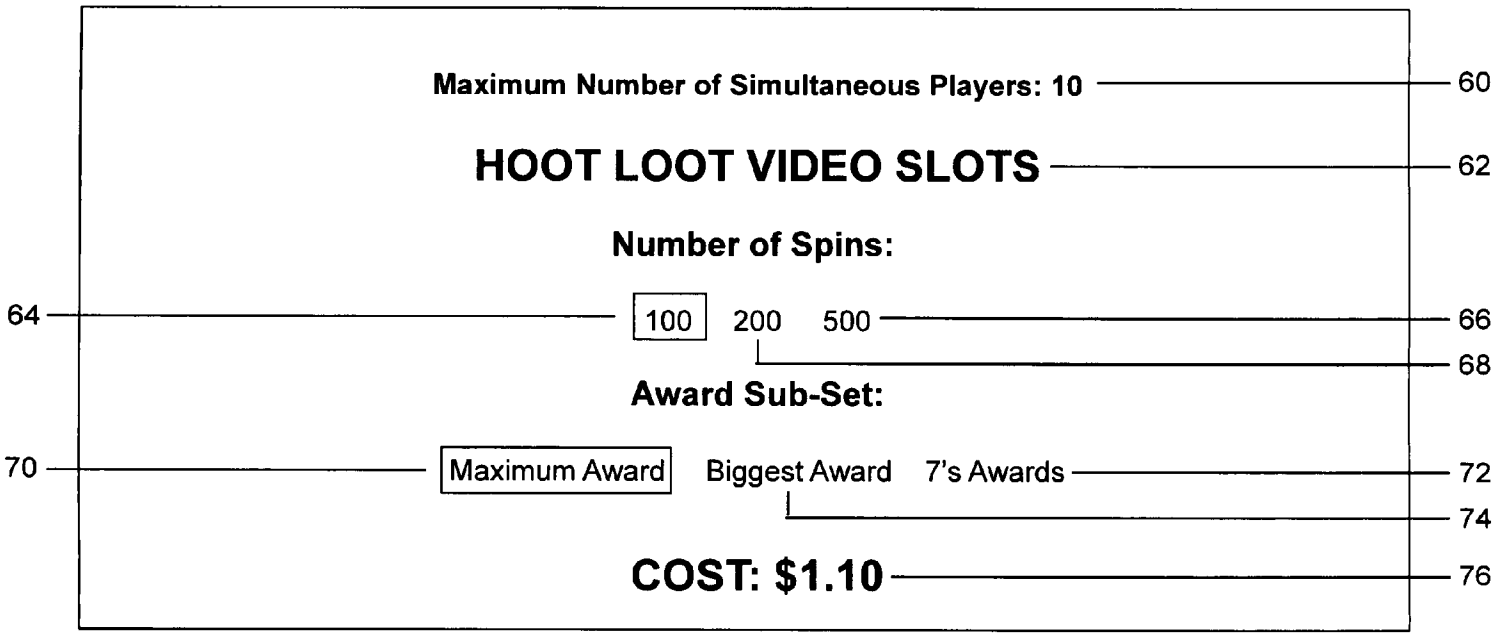
FIG. 1 shows a video screen which displays a purchase of spins and selection of awards for a slot machine game.
Figure 2:
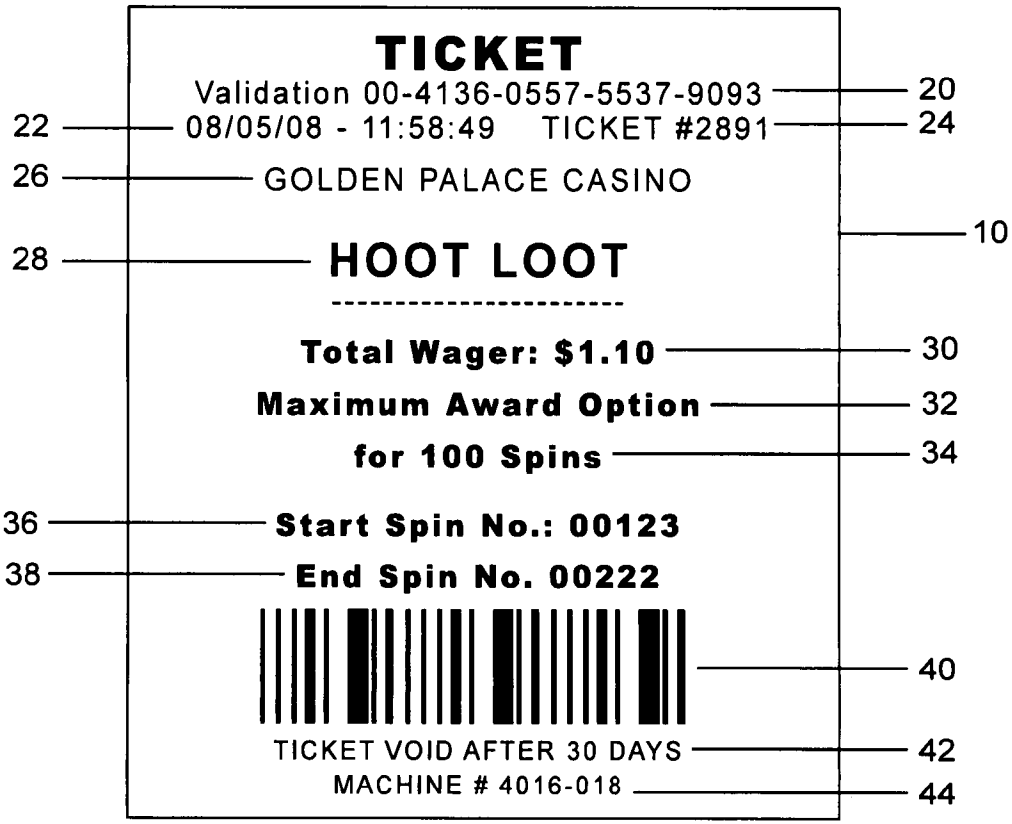
FIG. 2 shows a printed ticket which provides a record of purchased spins and selected award for a slot machine game.
Figure 3:
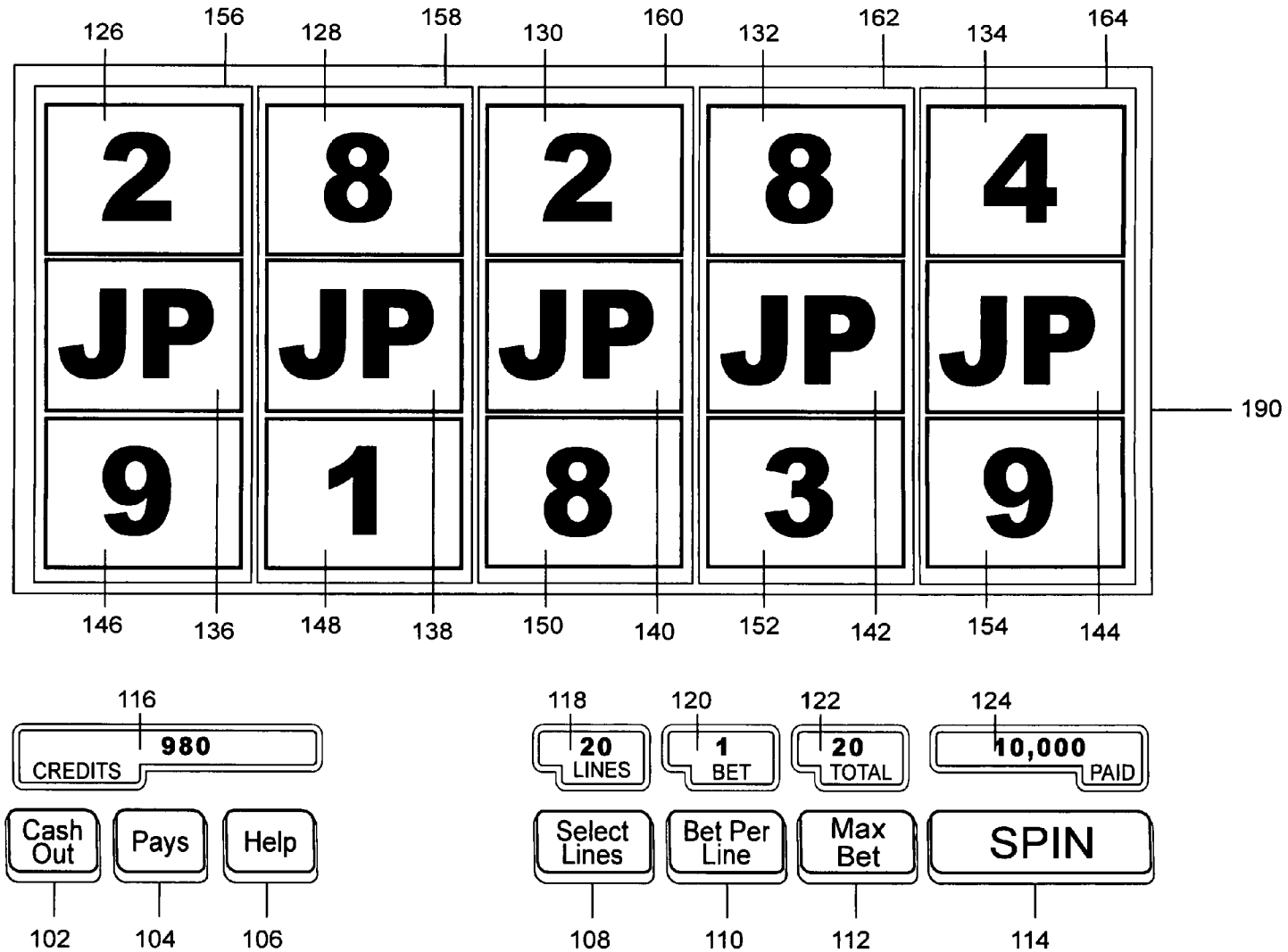
FIG. 3 shows a maximum award outcome of a slot machine game.

To play a preferred embodiment of the Present Invention, players may select a gaming device, select a number of games, select an award or sub-set of awards, pay for the selected wager, print-out a record of the wager, and collect awards, if any, following the selected number of games of the selected gaming device, as detailed below with reference to FIGS. 1, 2 and 3.

Number of Players—In the preferred embodiment, the gaming operator sets the maximum number of players that can simultaneously wager upon the same gaming device. In FIG. 1, indicates that the gaming operator has set the maximum number of player to 10 at 60. Alternatively, the Present Invention allows any number of players to simultaneously wager on the same device up to and including an unlimited number of simultaneous players wagering on the same device.

Select a Gaming Device—In the preferred embodiment, players select a video slot machine device. In FIG. 1, a player has selected a Hoot Loot video slot machine game 62. Alternatively, the Present Invention allows players to simultaneously wager on any gaming device, such as mechanical or video bingo, keno, slot, or poker games.

Select Number of Games. In the preferred embodiment, players select a number of games. In FIG. 1, a player selects the next 100 games played following payment, acceptance and verification of wager, as indicated by the box around the 100 at 64. The player may have also selected 200 games 66 or 500 games 68. Alternatively, the Present Invention allows for players to simultaneously wager on a gaming device by purchasing any number of spins, from 1 to any maximum set by the gaming operator and/or player. For example, players may purchase the maximum award during 500 spins of Slot 1. Further, the Present Invention allows for players to simultaneously wager on a gaming device by purchasing of any sequence of games, consecutive or non-consecutive, starting from any point in time. For example, players may purchase 100 games immediately following purchase and then another 100 games starting 1000 spins after purchase.

Select Sub-Set of Awards—In the preferred embodiment, players select from predetermined lists of award sub-sets, including: maximum award 70, biggest award 72, or "7" awards 74. In FIG. 1, a player selects maximum award 70, as indicated by the box around the maximum award selection 70. By selecting maximum award 70, players collect the maximum award (i.e. jackpot), if any such award occurs during the spins purchased by the players. Players selecting the biggest award 72 would collect the biggest award, as measured by credits, occurring during the spins purchased by the players. Players selecting "7s" awards 74 would collect an award for each winning "7" symbol combination appearing during the spins purchased by the players.

Alternatively, the Present Invention allows multiple players to simultaneously wager upon any awards, including the maximum award, biggest award, all awards, any sub-set of awards, a specific award, consecutive awards, consecutive losses, most awards, least awards, biggest cumulative value of awards, smallest cumulative value of awards, specific cumulative value of awards, and/or any other category of award or award type.

Place Wager—In the preferred embodiment, players place wagers using the same device that operates the slot machine game. For example, Player A purchases 100 spins of Slot 1 at Slot 1 and then Player B purchases 200 spins of Slot 1 at Slot 1. Alternatively, the Present Invention allows for any purchase point, such as purchase from the gaming device, a kiosk linked to multiple gaming devices, a server-based network system using master and slave gaming devices, or any other method for multiple players to purchase simultaneous play on gaming devices. For example, Player A may purchase 100 spins on Slot 1 at Slot 1; Player B may purchase 200 spins on Slot 1 using a kiosk in the casino lobby; Player C may purchase 150 spins on Slot 1 from Slot 2 using a server-based network system.

The purchase price for a selected wager is calculated by multiplying the odds of achieving the award or awards (O) times the amount of the award (A) times the number of spins purchased (N) times a hold-factor designed to provide the casino with a revenue stream (H); or, O*A*N*H. In FIG. 1, a player places a $1.10 wager 76 for the maximum award 70 during 100 spins 64 of a Hoot Loot game 62, as calculated by multiplying the 0.000001 odds of a maximum award on any pay line by the 10,000 credit maximum award by the 100 spins and then by a 1.1 hold-factor.

Alternatively, the Present Invention allows for any method of calculating the required wager, including any hold factor, any odds for an award, any amount of an award, or any number of spins. In addition, the purchase price may be affected by any other factor, such as the denomination of gaming machine, location of gaming machine on the casino floor, or player's betting profile as stored in a player tracking system.

Record of the Wager—In the preferred embodiment, players print-out a record of each simultaneous wager. In FIG. 2, a printed ticket 10 displays a total wager of $1.10 30 placed on the maximum award option 32 for 100 spins 34 of the selected Hoot Loot game 28. In addition, FIG. 2 shows the ticket verification data, including ticket validation number 20, date and time of ticket issuance 22, ticket number 24, place of ticket issuance 26, spin start number 36, spin end number 38, verification bar code 40, and identification number for the gaming device 44. Alternatively, the Present Invention allows for any method of storing and/or indicating the parameters of the purchase, such as displaying the information on a display, saving the information to a network server, or recording the information on a player card. For example, Player A purchases 100 spins on Slot 1 and receives a plastic card with a magnetic stripe that stores encoded data including the date of purchase, number of purchased spins, type of award, amount of award, identification code for the gaming device, spin start and end numbers, and ticket verification code.

Collect Awards—In the preferred embodiment, players collect an award if the selected award or a member of the selected award sub-set occurs during the selected number of games on the selected gaming machine. In FIG. 3, five "JP" (i.e. jackpot) symbols appear in five symbol positions 136, 138, 140, 142, and 144 of symbol matrix 190 to generate the maximum award. The results shown on FIG. 3 would award the maximum award of 10,000 credits XX to each player that placed a wager upon the maximum award for that spin.

In the preferred embodiment, the amount of an award is calculated by referring to the pay schedule for a 1-coin wager on the gaming device (not shown). For example, a 1-coin per payline pay schedule with a top award of 10,000 will issue a maximum award of 10,000 credits. Alternatively, the Present Invention allows for the calculation of awards using any method, such as calculating the maximum award by referring to the maximum-coin wager on the gaming device. For example, a 1-coin per payline pay schedule with a top award of 10,000 and a maximum-coin wager of 10 coins per pay line will issue a maximum award of 100,000 credits. Further, the award amount may vary depending on various factors, such as number of players simultaneously wagering upon the gaming device. For example, the casino may limit the total payout for any single spin to one billion credits and pro-rate any award that exceeds this amount amongst the winning players.

In the preferred embodiment, the gaming device that generates an award will also issue the award. For example, a slot machine prints a ticket for the maximum award during 100 spins of said slot machine; the maximum award occurs during the 100 spins; the ticket is entered into said slot machine's ticket acceptor; and, once validated, said slot machine issues an additional maximum award. Alternatively, the Present Invention allows for any method of issuing an award. For example, awards may issue via any device connected to a server-based system, such as an awards kiosk; print out on another gaming machine linked with the award generating machine, such as a local or wide-area network; and/or be recorded on electro-magnetic media, such as a player card.

In the preferred embodiment, awards only issue following the completion of the selected number of games. For example, a slot machine prints a ticket for the maximum award during 100 spins of said slot machine; the maximum award occurs on the third spin of the 100 spins; the ticket will only be validated and the award issued upon completion of all 100 spins. Alternatively, the gaming machine need not be operated until all selected games are completed. For example, awards may issue after a predetermined number or fraction of selected games are completed, after predetermined amount of time following the wager or generation of an award, and/or at any time during or after the selected games.

Operation of a Slot Machine Device

The Present Invention does not require that the players placing the simultaneous wagers operate the gaming device upon which wagers are placed. Any other player or combination of players may operate the gaming device to complete the number of selected games and generate selected awards, if any.

In a preferred embodiment, a player operates a slot machine game, in accordance with the rules and pay schedule of that particular slot game, by initializing credits, setting the wager, spinning the reels, and collecting awards for winning symbol combinations, as detailed below with reference to FIG. 3.

Initialize Credits. In FIG. 3, the player initializes credits by depositing money in the form of coins, gaming tokens or paper currency into a coin head (not shown) or bill acceptor (not shown). Coins and gaming tokens are collected in a reservoir (not shown) inside the gaming machine; paper currency is collected in the bill acceptor (not shown) inside the gaming machine.

If the coins, gaming tokens or paper currency are validated as authentic, the player accrues the appropriate number of playing credits on the Credit meter 116. More credits may be initialized, if necessary, by additional deposits. Alternatively, any method of initializing credits may be used including debit cards, credit cards, or other form of electronic funds transfer.

Set the Wager. In FIG. 3, the player sets the wager by selecting pay lines and setting the bet per pay line. The wager is calculated by multiplying the number of selected pay lines by the bet per pay line. For example, the player may wager a credit on each of twenty pay lines for a total bet of twenty credits. The total bet amount is displayed on the Total Bet meter 122.

To select pay lines, the player uses the Select Pay Lines button 108 and views the number of selected pay lines on the Select Pay Lines meter 118. Pay lines are selected in a predetermined order. For example, the first pay line selected is always pay line 1, second pay line selected is always pay line 2, etc. Alternatively, fewer or greater than twenty pay lines may be used with any order of pay line activation.

To set the bet per pay line, the player uses the Bet Per Pay Line button 110 and views the amount bet per pay line on the Bet Per Pay Line meter 120. The same amount is wagered on each pay line. For example, up to ten credits may be wagered on each pay line. Alternatively, wagers of any amount may be placed on a pay line, with the same or different amount wagered on each pay line.

In addition, the player may use the Bet Max button 112 to place the maximum bet per pay line on all pay lines. Alternatively, any wager may be assigned a button.

Spin the Reels. In FIG. 3, the player uses the Spin button 114 to randomly rearrange the symbols displayed in the symbol matrix 190. The symbol matrix 190 contains three symbol positions for each of the five slot reels 156-164 for a total of fifteen symbol positions 126-154. Alternatively, any number of reels with any number of symbol positions may be used.

The slot reels 156-164 spin and randomly stop one reel at-a-time, from left to right, until all five reels have stopped and all fifteen symbol positions 126-154 of the symbol matrix 190 are revealed. Alternatively, any size symbol matrix may be used and any method may be used to rearrange symbols in the symbol matrix.

Winning combinations. The player receives awards for winning symbol combinations formed by two or more, same, adjacent symbols, starting from the leftmost position of a pay line. In FIG. 3, five "JP" symbols form a winning symbol combination that generates the maximum or jackpot award of 10,000 times the bet per line, as shown on the Paid Meter 124. Note that other players that placed wagers upon the maximum award also receive a 10,000 credit award, as discussed in the Simultaneous Wagers by a Plurality of Players on the Same Gaming Device section above.

The player may also receive awards for winning symbol combinations formed using wildcards acting as other symbols in the symbol set. For example, four "JP" symbols and a wildcard symbol ("W") acting as a "JP" symbol would also be a winning five "JP" symbol combination with an award of 10,000 times the bet per line.

The use of a wildcard symbol to form a winning symbol combination does not affect the award value. For example, the winning combinations JP-JP-JP-JP-JP and JP-JP-JP-JP-W both award the same 10,000 times the bet per line award. Alternatively, wildcard symbols and/or expanded wildcard symbols may affect the award value of winning combinations.

All winning symbol combinations, including combinations with and without wildcard symbols, are listed on a predetermined pay schedule (not shown) along with their award values. The player may view the pay schedule (not shown) by pressing the Pays button 104. In addition, the player may press the Help button 106 to view the rules of the game (not shown).

Upon issuance of awards, the credits are added to the player's balance of credits, as shown on the Credit meter 116. As long as the player has credits remaining on the Credit meter 116, the player may continue to play the gaming machine. The player may also collect the balance of credits by pressing the Cash Out button 102.

The invention claimed is:

1. A method of operating a gaming device in which two or more players may simultaneously wager upon said gaming device such that:

a. a first group of one or more players wager upon a sub-set of future outcomes generated by said gaming device during a specified number of rounds of said gaming device;

b. a second group of one or more players operate said gaming device for some or all of the said specified rounds of said gaming device; and c. awards issue to the first and second group of players such that:

i) for each player of the first group, a particular player of the first group receives an award for any occurrence of an outcome wagered upon by the particular player of the first group, irrespective of whether the particular player of the first group operates said gaming device during a round of said gaming device in which the outcome wagered upon by the particular player of the first group occurs; and ii) for each player of the second group, a particular player of the second group receives an award for outcomes generated by said gaming device that are wagered upon by the particular player of the second group.

2. The method of claim 1, further comprising:

each player of the first group purchasing a wager upon the sub-set of future outcomes generated by said gaming device during said specified number of rounds, the wager purchased at a cost equal to: (odds of achieving an outcome)×(amount of award for achieving the outcome)×(specified number of rounds wagered upon for the outcome)×(a hold-factor).

3. The method of claim 1, wherein the specified number of rounds is multiple rounds.

4. A method of operating a gaming device in which two or more players may simultaneously wager upon said gaming device, the method comprising:

a. receiving a first wager from a first player of said gaming device, the first wager providing a wager on a sub-set of future outcomes generated by said gaming device during a specified number of rounds of said gaming device;

b. receiving a second wager from a second player of said gaming device, the second player operating said gaming device during at least one of the specified number of rounds on which the first player has wagered, and the second wager providing a wager on an outcome generated by said gaming device;

c. issuing awards to the first player and the second player in accord with i) occurrences of outcomes on which the first player and the second player have wagered, and ii) a pay schedule of said gaming device, said gaming device issuing awards to the first player irrespective of whether the first player operates said gaming device during a round of said gaming device in which an outcome wagered upon by the first player occurs.

5. The method of claim 4, further comprising:

a. receiving at least one additional wager from at least one additional player of said gaming device, each of the at least one additional wager providing a wager on a sub-set of future outcomes generated by said gaming device during a specified number of rounds of said gaming device; and b. issuing awards to the at least one additional player in accord with i) occurrences of outcomes on which the at least one additional player has wagered, and ii) a pay schedule of said gaming device, said gaming device issuing awards to the at least one additional player irrespective of whether the at least one additional player operates said gaming device during a round of said gaming device in which an outcome wagered upon by the at least one additional player occurs.

6. The method of claim 4, wherein said first wager and said second wager are made at said gaming device.

7. The method of claim 4, wherein said gaming device provides a slot machine game, and wherein said first wager and said second wager are made at said gaming device.

8. The method of claim 4, wherein said gaming device provides a video poker game, and wherein said first wager and said second wager are made at said gaming device.

9. The method of claim 4, wherein said first wager is made at a purchase point networked to said gaming device.

10. The method of claim 9, wherein said second wager is made at said gaming device.

11. The method of claim 4, wherein at least one of said awards has an amount dependent on a total number of players simultaneously wagering upon said gaming device.

12. The method of claim 4, wherein said awards are issued at said gaming device.

13. The method of claim 4, wherein at least one of said awards is issued to said first player at an award kiosk, and wherein at least one of said awards is issued to said second player at said gaming device.

14. The method of claim 4, wherein said gaming device is a slot machine having a number of reels, and wherein said specified number of rounds is a specified number of spins of said reels.

15. The method of claim 14, wherein the slot machine is a video slot machine.

16. The method of claim 4, wherein said first wager is a wager upon a maximum award for said gaming device.

17. The method of claim 4, wherein said first wager is a wager upon a biggest award issued by said gaming device during said specified number of rounds.

18. The method of claim 4, wherein said specified number of rounds is multiple rounds.

19. The method of claim 4, wherein said specified number of rounds includes non-consecutive rounds.

* * * * *